US007052329B2

(12) United States Patent
Belopolsky et al.

(10) Patent No.: US 7,052,329 B2
(45) Date of Patent: May 30, 2006

(54) ELECTRICAL CONNECTOR WITH AN INTERNAL MODEM

(75) Inventors: Yakov Belopolsky, Harrisburg, PA (US); Michael Yeomans, Camp Hill, PA (US); Charles Blichasz, York, PA (US); Kevin E. Walker, Hershey, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/912,958

(22) Filed: Aug. 6, 2004

(65) Prior Publication Data

US 2006/0030220 A1 Feb. 9, 2006

(51) Int. Cl.
*H01R 24/00* (2006.01)

(52) U.S. Cl. ..... 439/676; 439/620

(58) Field of Classification Search ..... 439/676, 439/540.1

See application file for complete search history.

(56) References Cited

U.S. PATENT DOCUMENTS

| | | | | |
|---|---|---|---|---|
| 4,603,320 | A | 7/1986 | Farago | |
| 4,686,506 | A | 8/1987 | Farago | |
| 4,972,470 | A | 11/1990 | Farago | |
| 6,417,812 | B1 * | 7/2002 | Tsai | 343/725 |
| 6,641,440 | B1 * | 11/2003 | Hyland et al. | 439/620 |
| 6,835,098 | B1 * | 12/2004 | Chang | 439/620 |
| 6,896,553 | B1 * | 5/2005 | Espenshade et al. | 439/620 |
| 2004/0224558 | A1 * | 11/2004 | Wan et al. | 439/541.5 |

* cited by examiner

*Primary Examiner*—Hae Moon Hyeon
(74) *Attorney, Agent, or Firm*—Wei Te Chung

(57) ABSTRACT

An electrical connector (100) includes an RJ 45 block (3), an RJ11 component (5), a stacked USB component (4) and an internal modem (6) having a plurality of pinholes (61) and electrical components and circuitry. The RJ45 block (3) includes a header (35) defining a plurality of slots (351). A plurality of right-angle pins (352) are received in corresponding slots and inserted into corresponding pinholes of the modem. The RJ11 component includes a plurality of contacts being directly soldered to the modem. The stacked USB component abuts against the modem.

20 Claims, 7 Drawing Sheets

ELECTRICAL CONNECTOR WITH AN INTERNAL MODEM

BACKGROUND OF THE INVENTION

1. Field of the Invention

This invention generally relates to an electrical connector used in the telecommunication and data communication field and more particularly, to an electrical connector with an internal modem board for integrating multiple types of data handling equipments.

2. Description of the Prior Art

Due to continuing trends toward miniaturization, PCs and notebooks require improved electrical connectors. The modern trend of electrical connectors to integrate numerous discrete electrical components within single semiconductor integrated circuitry, has produced greater economies in the manufacture. U.S. Pat. No. 4,686,506 issued to Farago discloses an electrical connector having a parallel internal integrated circuitry for processing signal and data from two different signal handling equipments. The conventional electrical connector includes a housing defining a front wall and a bottom wall. The front wall defines a plurality of jacks for mating with a plurality of complementary connectors having a number of contacts. The bottom wall contains an electrical circuitry board parallel abutting against an interior surface of the bottom wall and forming a numerous various of chips and capacitors for processing signals and data. The contacts directly electrically connect with the electrical circuitry board of the bottom wall of the housing to realize the signal transmitting and processing. However, the electrical circuitry board is paralleled disposed on the bottom wall of the housing, thereby consuming more room and further impairing the trend toward miniaturization of PCs and notebooks. In addition, the project requires additional components on either a PCI card or system board to complete the circuitry board. Therefore, it is deemed advantageous to have a full circuitry board which can obtain all the necessary components. However, we will face another problem to solve how we can get a sufficient projected area for a circuitry board which can obtain all the necessary components.

Hence, an improved electrical connector is desired to overcome the above problems and meet the PCs and notebook miniaturized.

BRIEF SUMMARY OF THE INVENTION

It is an object of the present invention to provide an electrical connector which has a compact structure.

It is another object of the present invention to provide an electrical connector which can provide multi functions at the same time.

In order to attain the objective above, an electrical connector according to the present invention includes an outer shield, a housing, an RJ45 block, an RJ11 contact, a stacked USB component and a modem integrated with the RJ45 block, the RJ11 and the USB component. The shield and housing combined to define a plurality of receptacles for mating with a plurality of mating plugs. The modem defines a plurality of pinholes and electrical components and circuitry. The RJ45 includes an integrated housing, a header positioned in a rear and bottom portion of the housing. The header defines a plurality of interlaced slots and a plurality of right-angle pins being received in the slots. The right-angle pins are inserted into the pinholes of the modem and electrically connect with the modem. The RJ11 component includes a plurality of contacts are directly soldered to the modem. As a result, the modem integrate with the RJ45 contact block, the RJ11 contact and the stacked USB component and is vertically disposed on a back portion of the housing, thereby effectively utilizing the limited available system boards area.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Reference will now be made in detail to the preferred embodiment of the present invention.

Figure 1:
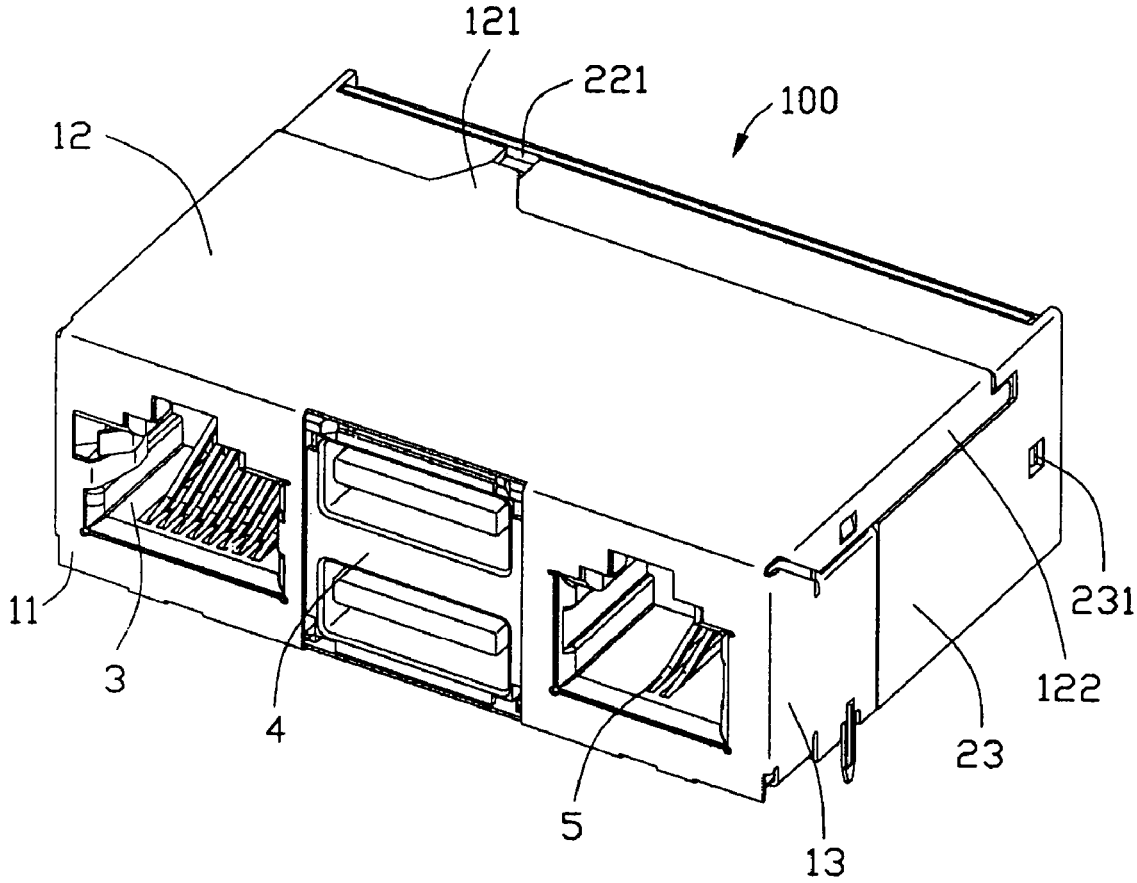
FIG. 1 is a perspective view of an electrical connector according to the present invention.
Figure 2:
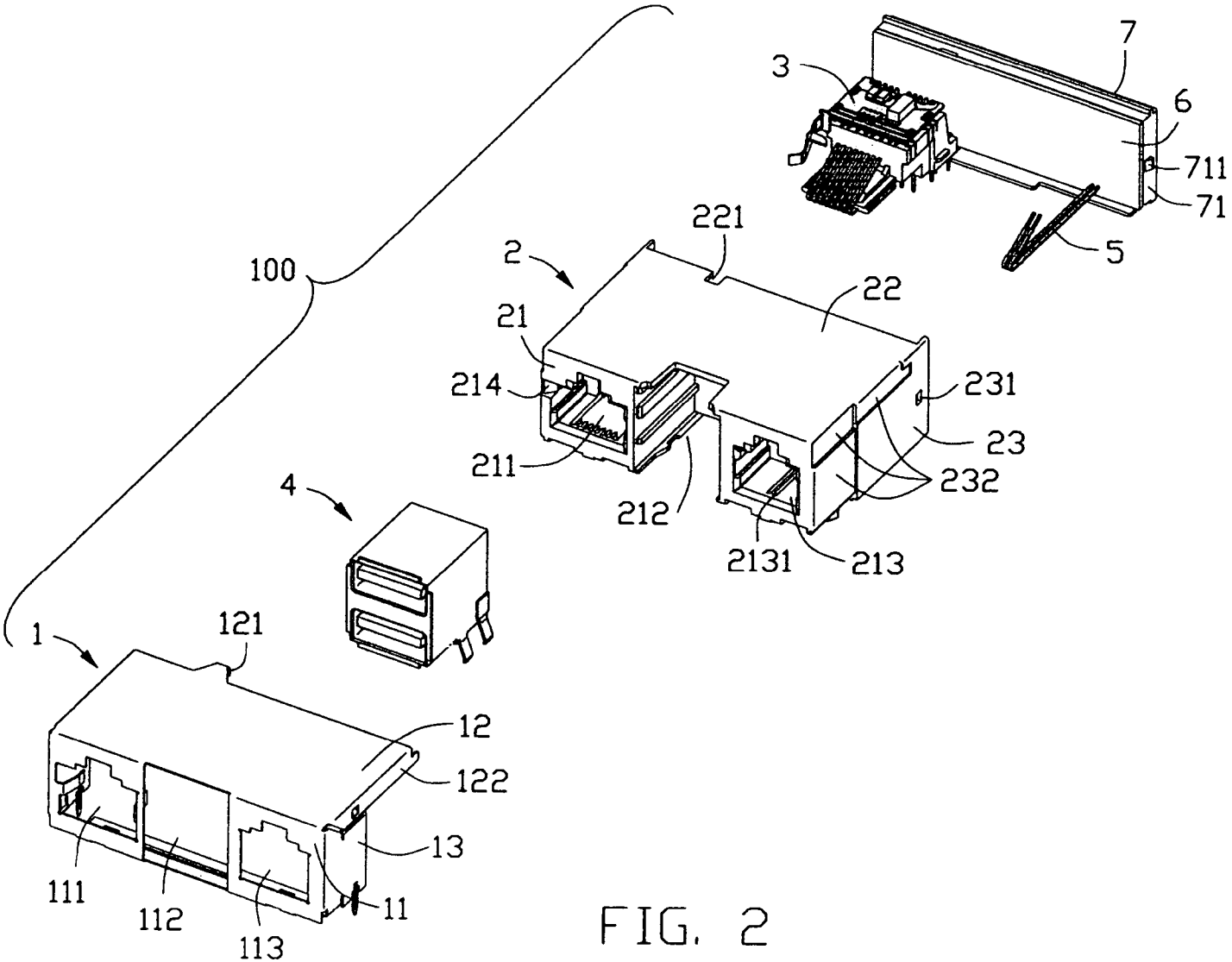
FIG. 2 is an exploded view of the electrical connector.

As shown in FIG. 2, an electrical connector 100 adapted for mounting on a printed circuit board (not shown) according to the present invention includes an outer metal shield 1, a housing 2 being enclosed by the shield 1, a RJ45 contact block 3 and a first contact block 5 integrated with a modem board 6, a second component 4 fixed in the housing 2, a back cover 7 snapping on the back of the housing 2 to isolate the modem board 6 from a system board (not shown). In this present invention, the first contact block 5 is a RJ11 contact block and the second component 4 is a stacked USB component, as more fully detailed hereinafter.

As depicted in FIG. 2, the shield 1 is stamped by a metal sheet and includes a front mating face 11 defining a plurality of openings 111, 112 and 113 for respectively appropriately exposing the RJ45 contact block 3, the stacked USB component 4 and the RJ11 contact 5. A pair of flaps 13 respectively extend backwardly from opposite ends of the front mating face 11. The shield 1 further includes a top face 12 substantially perpendicular to the front face 11 and a latch 121 downwardly bends and extends from a rear edge of the top face 12. A pair of limbs 122 respectively downwardly extend from opposite ends of the top face 12.

Figure 3:
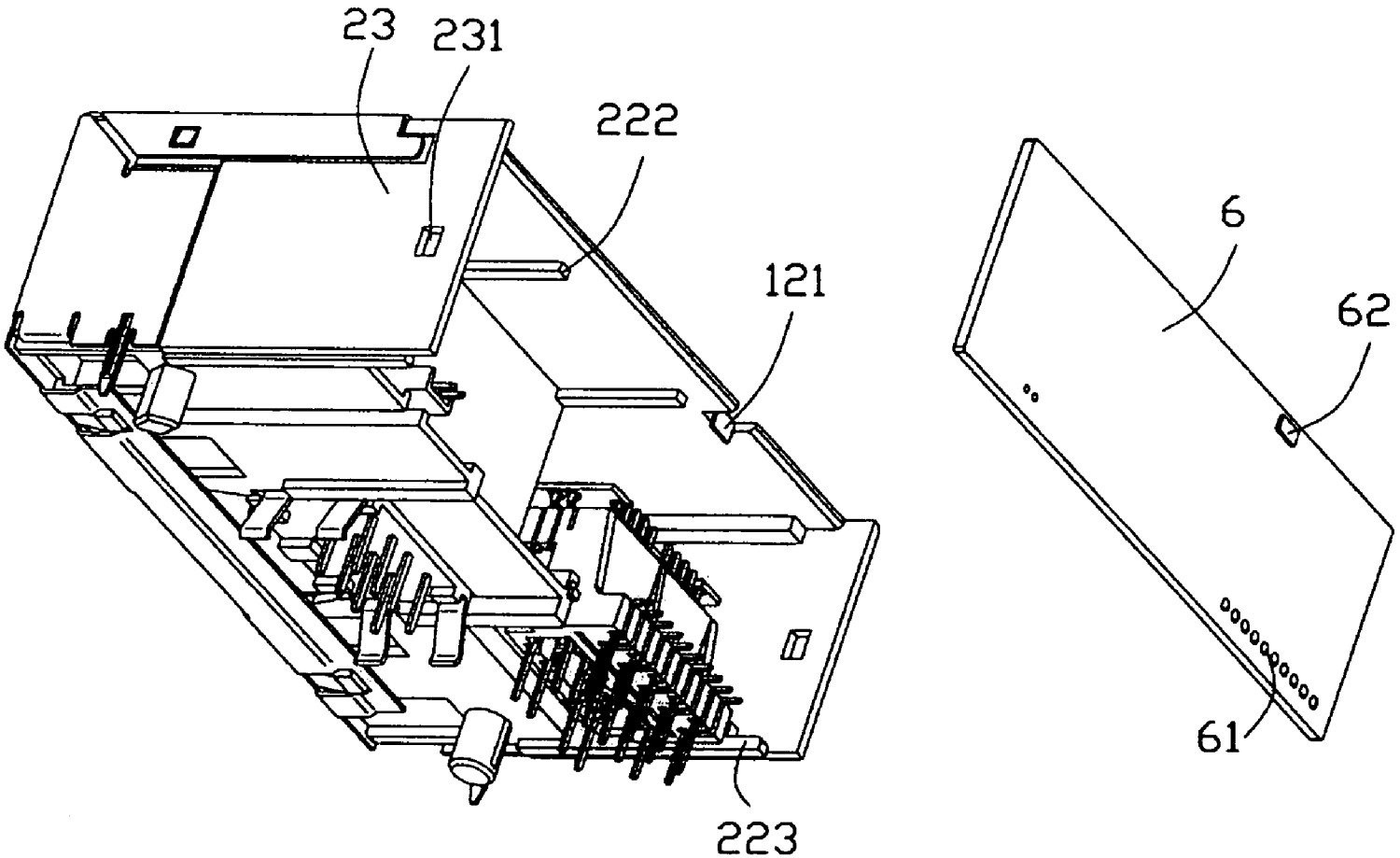
FIG. 3 is a partially exploded view of the electrical connector with the back cover removed away.

Referring to FIG. 2 in conjunction with FIG. 3, the housing 2 is formed by plastic material and includes a front face 21 defining a big receptacle 211 for receiving the RJ45 contact block 3, a chamber 212 for receiving the USB component 4 and a small receptacle 213 for receiving the RJ11 contact 5 respectively appropriately exposing to the openings 111, 112 and 113 of the shield 1. The housing 2 further includes a top face 22 substantially perpendicular to the front face 21 and a pair of sidewalls 23 backwardly extending from the front face 21 to beyond the top face 22. Each sidewall 23 defines a plurality of staggered depressed area 232 for preferably engaging with the flap 13 and the limb 122 of the outer metal shield 1, thereby securing the shield 1 to the housing 2. The top face 22 forms a plurality of longitudinal beams 222 downwardly projecting from an interior surface thereof. Each sidewall 23 forms a stepped portion 223 interiorly projecting from a bottom portion thereof. A plurality of passageways 2131 are defined in the small receiving room 213. A groove 214 is defined in an inner surface of a sidewall of the big receptacle 211. The top face 22 defines a recess 221 positioned in a rear edge thereof for appropriately engaging with the latch 121 of the shield 1, thereby further securing the shield 1 on the housing 2. Each sidewall 23 defines a notch 231 adjacent to a rear edge thereof.

Figure 4:
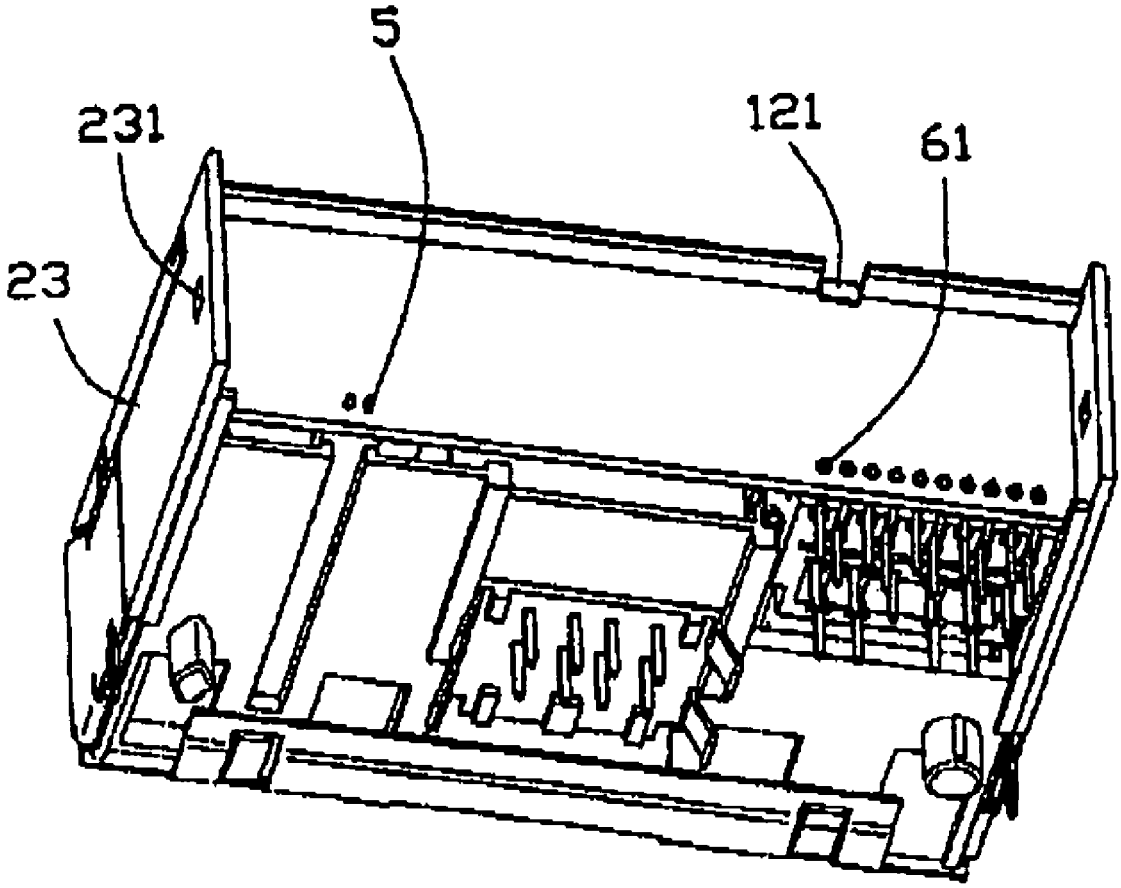
FIG. 4 is a partially assembled view of the electrical connector with the back cover removed away.

Referring to FIGS. 2–4, the modem board 6 defines a plurality of pinholes 61 and a plurality of electrical components and circuitry (not shown) for acting upon signals and data. The modem board 6 is assembled into the housing 2, with a top portion thereof abutting against the beams 222 of the housing 2 and a bottom portion thereof resisting on the stepped portion 223 of the housing 2. The modem board 6 is captured by the housing 2 at four corners, thereby maximizing the available area for components. Furthermore, the latch 121 of the metal outer shield 1 abuts against a corresponding electrical pad 62 of the modem board 6 through the recess 221 of the housing 2, thereby realizing grounding function and further eliminating signal interference produced on the modem board 6.

The cover 7 is stamped from a metal sheet and defines a circumferential sidewalls 71, thereby forming a receiving room for receiving the modem board 6 and separating the modem board 6 from the system boards. The cover 7 further includes a pair of protrusions 711 on opposite sides of the sidewalls 71 for latching into the notches 231 of the housing 2.

Figure 5:
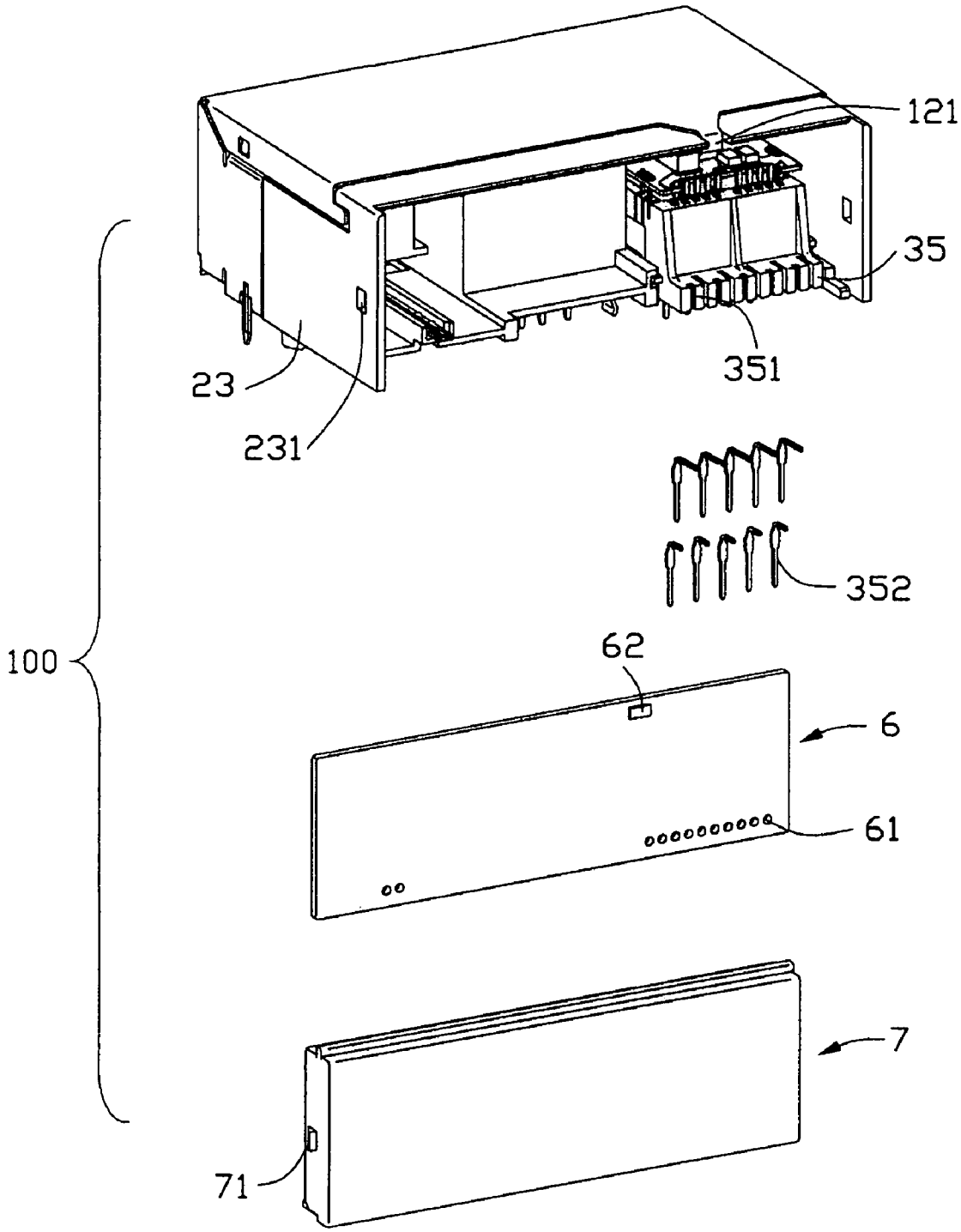
FIG. 5 is an exploded view of the electrical connector from a back perspective.
Figure 6:
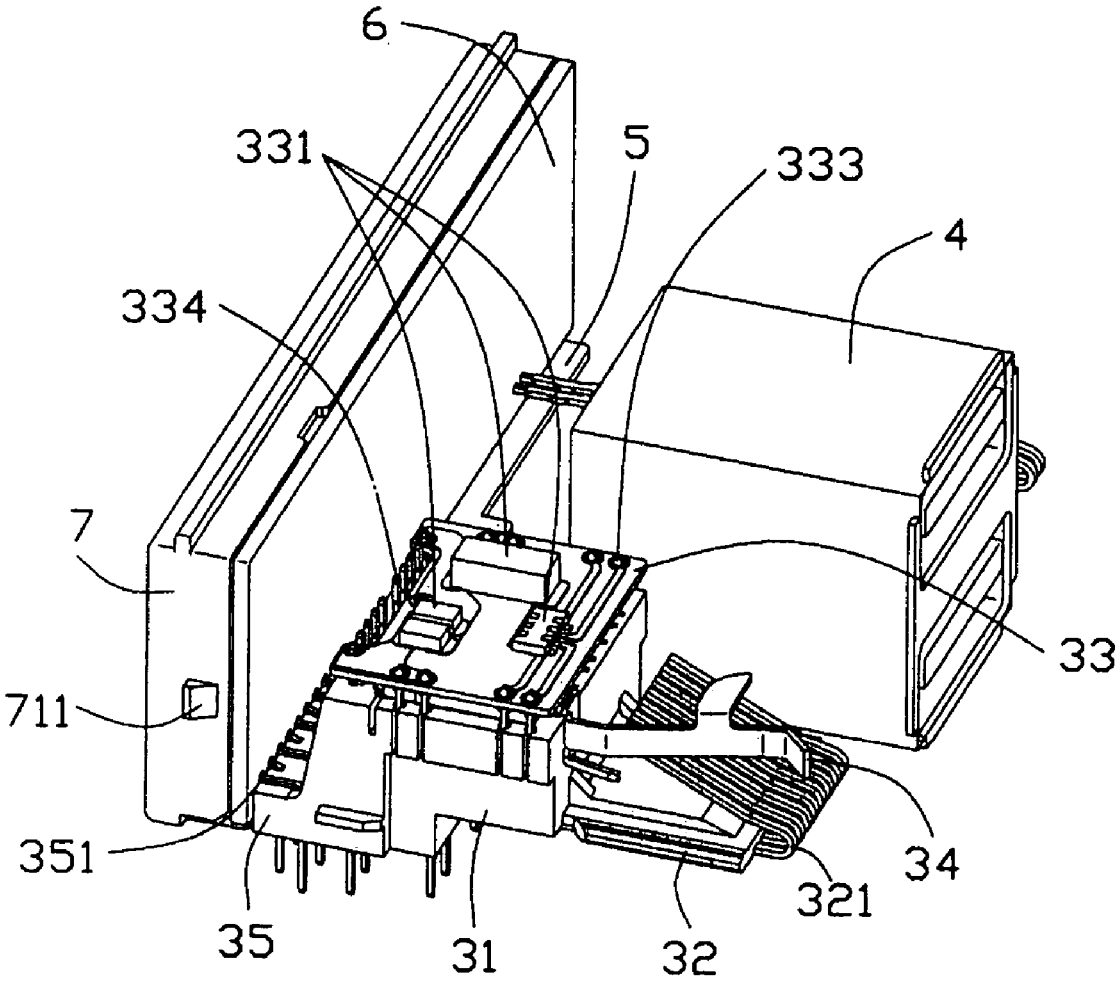
FIG. 6 is a partially assembled view of the electrical connector with the full modem integrated with the RJ45 contact block and the RJ11 contact.
Figure 7:
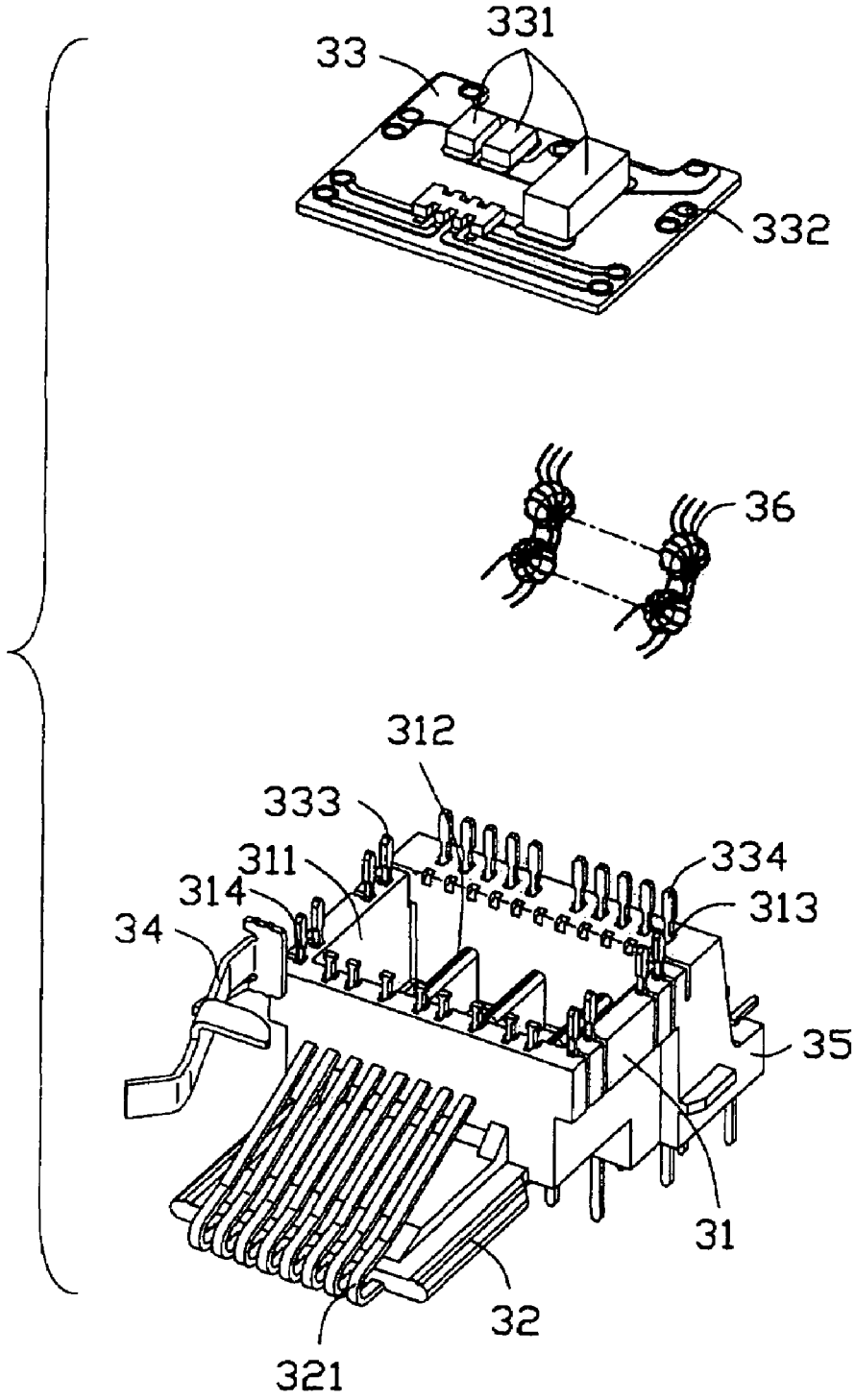
FIG. 7 is an exploded view of the RJ45 contact block of the electrical connector.

Referring to FIGS. 5–7, the RJ45 block 3 comprises an integral main body 31, a flat portion 32 transversely extending from a bottom portion of the main body 31, an internal printed circuit board 33 disposed above the main body 31 and a plurality of contacts 321 fixed on the flat portion 32 with one end of each contact 321 projecting beyond a top surface of the main body 31. The RJ45 block 3 includes a header 35 backwardly projecting from a rear and bottom portion of the main body 31. The header 35 defines a plurality of interlaced slots 351 and a plurality of right-angle pins 352 being received in corresponding slots 351 inserted into the pinholes 61 of the modem board 6. A cantilevered beam 34 forwardly extends from a front portion of the main body 31 for engaging with the groove 214 of the receptacle 211 of the housing 2, thereby securing the RJ45 block 3 in the housing 2. The RJ45 contact block 3 further defines two sets of pin arrays 333, 334 different in length, which are fixed in the integral main body 31.

As depicted in FIG 7, the integral main body 31 defines a receiving cavity 311 through a top surface thereof. A plurality of barriers 312 are formed in a bottom surface of the receiving cavity 311 and upwardly project into the receiving cavity 311, thereby dividing the receiving cavity 3 11 into a plurality of receiving slots (not labeled). A number of magnetic coils 36 for further eliminating the cross talk caused in signal transmission are disposed in the receiving slots of the receiving cavity 311 respectively separated by corresponding barrier 312. The integral main body 31 defines a plurality of apertures 313 in the top surface and through a bottom surface thereof for receiving the long pin array 334 to electrically connecting with the printed circuit board. The integral main body 31 further defines a plurality of recesses 314 in a peripheral area of the top surface for receiving the short pin array 333.

Referring to FIGS. 6–7, the internal printed circuit board 33 contains a plurality of signal conditioning components 331, such as capacitors and resistors used for signal conditioning and termination. The internal printed circuit board 33 further defines a plurality of plated through holes 332 therein. At the same time, two of the long pin array 334 for grounding terminals and the short pin array 333 penetrate through corresponding plated through holes 332 and are soldered therein, thereby electrically connecting with the internal printed circuit board 33 above the main body 31.

It is noted that the contacts 321 and the long pin array 334 (not the two pins 334 fixed by the internal printed circuit board 33) are connected by corresponding magnetic coils 36, since the long pin array 334 electrically connecting with the printed circuit board, thereby forming an integral electrical connecting for transmitting signal received by the contacts 321 among the contacts 321, the long pin array 334, the magnetic coils 36 and the printed circuit board. The short pin ray 333 is connected with the corresponding magnetic coils 36. At the same time, the short pin ray 333 electrically connects with the internal printed circuit board 33. Therefore, the electronic magnetic interference (EMI) produced in transmission procedure is filtrated trough the signal conditioning components on the internal printed circuit board 33 and grounded through the two long pins 334 electrically connecting with the internal printed circuit board 33.

Referring to FIGS. 1–7, in assembly, firstly, the stacked USB component 4 is fixed in the chamfer 212 of the housing 2. The RJ45 contact block 3 connects with the modem board 6, with an end of each pin 352 of the header 35 being inserted into the pinholes 61 of the modem 6 and opposite end of each pin 352 being inserted into corresponding hole (not shown) of the printed circuit board, thereby forming an electrical connection between the printed circuit board and the modem board 6. The RJ11 contacts 5 are directly soldered to the modem board 6. Secondly, the modem board 6 integrated with the RJ45 contact block 3 and the RJ11 contact 5 is assembled in the housing 2, with the cantilevered beam 34 of the RJ45 contact block 3 engaging with the groove 214 of the big receptacle 211 of the housing 2, the RJ11 contact 5 being retained in the corresponding passageways 2131 of the small receptacle 213 of the housing 2. The modem board 6 is captured by the housing 6 by a top portion thereof abutting against the beams 222 of the top face of the housing 6 and a bottom portion resisting against the stepped portion 223 of the housing 6. Thirdly, the cover 7 snaps on back of the housing 2 to isolate the modem board 6 from the system board, with the protrusions 711 being latched into the corresponding notches 231 of the housing 2. Finally, the shield 1 encloses the housing for preventing electromagnetic interference (EMI), with the latch 121 of the shield 1 hooking the recess 221 of the housing 2.

In the present invention, the modem board 6 is assembled in the electrical connector 100 and integrates with the RJ45 contact block 3, the RJ11 contact 5 and the stacked USB component 4, the customer only to handle on unit during the assembly rather than multiple connectors, modem components and cabling, thereby effectively reducing the assemble process and simplifying the structure of the electrical connector 100. Furthermore, the integration with a vertical modem board 6 in the electrical connector 100 will be more cost effective and take less system board area. At the same time, the projected area of the RJ45 contact block 3, the RJ11 contact 5 and the stacked USB component 4 combined allows for a modem 6 of sufficient size to contain all components, otherwise requires either a PCI card or a system board to accommodate components to complete the modem 6.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector adapted for mounting on a printed circuit board, comprising:

a housing having a first and a second receptacles at a front thereof;

a modem board vertically disposed at a rear of the housing;

a plurality of pins connected with the modem board for electrically connecting the modem board to the printed circuit board;

an RJ contact block disposed within the housing and being accessible through the first receptacle; and a pair of contacts disposed within the housing and being accessible through the second receptacle, the pair of contacts being electrically connected to the modem board.

2. The electrical connector according to claim 1, wherein the modem board defines a plurality of pinholes for receiving individual ends of the pins.

3. The electrical connector according to claim 2, wherein the contact block defines a header in a rear portion thereof, and wherein the header defines a plurality of slots for receiving the pins.

4. The electrical connector according to claim 1, wherein the housing defines a sidewall forming a stepped portion in an interior surface thereof for resisting against the modem board.

5. The electrical connector according to claim 1, wherein the housing defines a top face forming a beam in an interior surface thereof for abutting against the modem board.

6. The electrical connector according to claim 1, wherein the housing defines a recess in a rear edge thereof, and wherein the electrical connector further comprises an outer metal shield having a top face, the top face forming a latch for abutting against the modem board through the recess of the housing.

7. The electrical connector according to claim 1, wherein the contact block comprises a main body, a horizontally extending flat portion and a plurality of contacts fixed in the flat portion.

8. The electrical connector according to claim 7, wherein the contact block further defines a beam forwardly extending from a front portion of the main body, and wherein the first receptacle of the housing defines a groove for engaging with the beam.

9. The electrical connector according to claim 8, wherein the contact block has an internal printed circuit board disposed above the main body and two sets of pin arrays fixed in the main body.

10. The electrical connector according to claim 9, wherein the two sets of pin arrays include a first pin array extending through the main body and electrically connecting with the printed circuit board and a second pin array electrically connecting with the internal printed circuit board, two pins of the first pin array electrically connecting with the internal printed circuit board and realizing a grounding function.

11. The electrical connector according to claim 10, wherein the main body of the contact block defines a receiving cavity and a plurality of barriers dividing the receiving cavity into a plurality of receiving slots.

12. The electrical connector according to claim 11, wherein the contact block further has a plurality of magnetic coils being disposed in the receiving slots of the receiving cavity.

13. The electrical connector according to claim 12, wherein the magnetic coils electrically connect with the two sets of pins for transmitting signals and eliminating a crosstalk.

14. The electrical connector according to claim 1, further comprising a back cover mounted to the housing.

15. The electrical connector according to claim 14, wherein the back cover defines a pair of protrusions, and wherein the housing defines a pair of notches for engaging with the corresponding protrusions of the cover.

16. The electrical connector according to claim 1, further comprising a USB component being disposed in the housing and mounted on the printed circuit board.

17. The electrical connector according to claim 1, wherein said RJ contact block is an RJ45 contact block.

18. The electrical connector according to claim 1, wherein said pair of contacts are RJ11 contacts.

19. An electrical connector adapted for mounting on a printed circuit board, comprising:

a housing having a first and a second receptacles at a front thereof;

a modem board vertically disposed at a rear of the housing;

a plurality of pins connected with the modem board for electrically connecting the modem board to the printed circuit board;

a contact block disposed within the housing and being accessible through the first receptacle; and a pair of contacts disposed within the housing and being accessible through the second receptacle, the pair of contacts being electrically connected to the modem board; wherein said first receptacle and said second receptacle are similar to each other.

20. An electrical connector adapted for mounting on a printed circuit board, comprising:

a housing having a first and a second receptacles at a front thereof;

a modem board vertically disposed at a rear of the housing;

a plurality of pins connected with the modem board for electrically connecting the modem board to the printed circuit board;

a contact block disposed within the housing and being accessible through the first receptacle; and a pair of contacts disposed within the housing and being accessible through the second receptacle, the pair of contacts being electrically connected to the modem board; wherein the housing defines a top face forming a beam in an interior surface thereof for abutting against the modem board.

* * * * *